United States Patent [19]

Koenig

[11] 3,944,312

[45] Mar. 16, 1976

[54] LOCKING DEVICE FOR SPADE-TYPE ELECTRICAL CONNECTORS

[75] Inventor: Thomas J. Koenig, Louisville, Ky.

[73] Assignee: General Electric Company, Louisville, Ky.

[22] Filed: Apr. 4, 1975

[21] Appl. No.: 565,201

[52] U.S. Cl. ..... 339/59 R; 339/217 R; 339/258 S

[51] Int. Cl.$^2$ ..... H01R 13/42

[58] Field of Search ..... 339/59–61, 339/217, 91, 256 SP, 258 S

[56] References Cited

UNITED STATES PATENTS

| | | | |
|---|---|---|---|
| 3,763,458 | 10/1973 | Taormina | 339/59 R |
| 3,781,760 | 12/1973 | Mancini et al. | 339/59 M |
| 3,825,880 | 7/1974 | Battaglia et al. | 339/59 R |

*Primary Examiner*—Joseph H. McGlynn

[57] ABSTRACT

A locking device for maintaining electrical connection in spade-type connectors. The locking device has two interconnecting parts, each of which positively receives a terminal of the spade-type connector. The locking device includes means which prevent the lateral and translational movement of the spade connector terminals therewithin, so that they are held in ready alignment for connection.

3 Claims, 2 Drawing Figures

LOCKING DEVICE FOR SPADE-TYPE ELECTRICAL CONNECTORS

BACKGROUND OF THE INVENTION

Heretofore, connectors have been suggested for readily making the electrical connections between terminal ends of wires. Initially, connectors were suggested such as spade-type connectors. Their advantage was that they were easy to assemble and thereby allowed wiring of various components of an apparatus at a location remote from the manufacturing site.

Later, it was concluded that if the various terminal ends of electrical wires of an apparatus were affixed in a mold and had a connection block molded therearound, positive locked connection could be effected and would be superior to spade-type connectors.

Applicant has now devised a locking device which can be readily adapted to apparatus already having spadetype connectors which may, for example, be in service and therefore not readily subject to having the wire terminal ends molded into a locking device. In the alternative, Applicant's locking device may be used with new components, supplied by a vendor, with wiring whose terminal ends have spade-type connectors. In either event, the locking device of this invention may be later added to wire terminal ends having spade-type connection elements thereon to effect positive locked connection therebetween.

The spade-type connectors to which this invention relates are well known in the art and are shown as elements 10 and 12 in FIG. 1.

The present invention is a new and novel locking device which obviates the need to mold wire terminal ends thereinto, yet maintains the connectors in readily-aligned position and secures them in positive locked relationship when assembled.

SUMMARY OF THE INVENTION

The present invention includes a two-part locking device for maintaining electrical connection in spade-type connectors wherein each part positively receives one terminal of a spade-type connection readily aligned in connecting relationship. The parts are, in turn, interlockingly assembled to effect positive connection therebetween. More specifically, the invention includes a locking device for maintaining electrical connection in spade-type connectors comprising a case and an insert telescoping at least partially thereinto, both being interconnectable by a single, centrally-located attaching means. The case includes opposed sidewalls and a top and bottom wall, thereby defining a rectangular box. The box contains a plurality of upstanding wedges in opposed relationship to form a constriction; the distance between the wedges, when measured diagonally, is greater than the width of the spade member of the spade connection and the distance between which, when measured transversely, is less than the width of the spade member to thereby engage the rear edges of the spade member, inserted into the case through a first end opening, to prevent the spade member's withdrawal from the case. The case further includes a flexible tongue integral with the bottom wall at the first end, the tongue having located at its free end a projection forming a part of the attaching means. The insert includes opposed sidewalls and top and bottom walls, thereby defining a rectangular box of slightly smaller dimensions than the box of the case, thus permitting the insert to be partially telescoped into the case. The insert further includes inwardly projecting detents integral with the top wall thereof to engage a spade-receiving member of a spade connection inserted into the insert through a first end opening to likewise prevent its withdrawal from the insert. The insert further comprises a wall extending parallel to and equidistant from the opposed sidewalls to divide the insert into two compartments, each having one of the detents projecting from the top wall downwardly thereinto. The top wall further includes an upwardly convoluted portion adjacent the first end to accommodate the connection of a wire to the spade-receiving member, the insert being insertable into the case to cause the wedges and detents, respectively, to hold the spade portions and the spade-receiving portions in electrical connection when the projection is hooked behind the first end of the insert. The locking device of this invention preferably includes projections attached to the underside of the detent of the insert, to engage the spade-receiving member and thereby prevent it from being either withdrawn or extended through the respective compartment of the insert.

Further, it is desirable that the wedges located in the case of the locking device cooperate to define a tapered entrance which guides a spade member inserted into the case into position to be secured therein.

The invention of this disclosure has been found useful for securing the members of a spade-type connection in positive electrical connection, thereby preventing uncoupling of connections in the circuitry of major appliances during shipment and installation thereof.

DESCRIPTION OF THE PREFERRED EMBODIMENT

Figure 1:
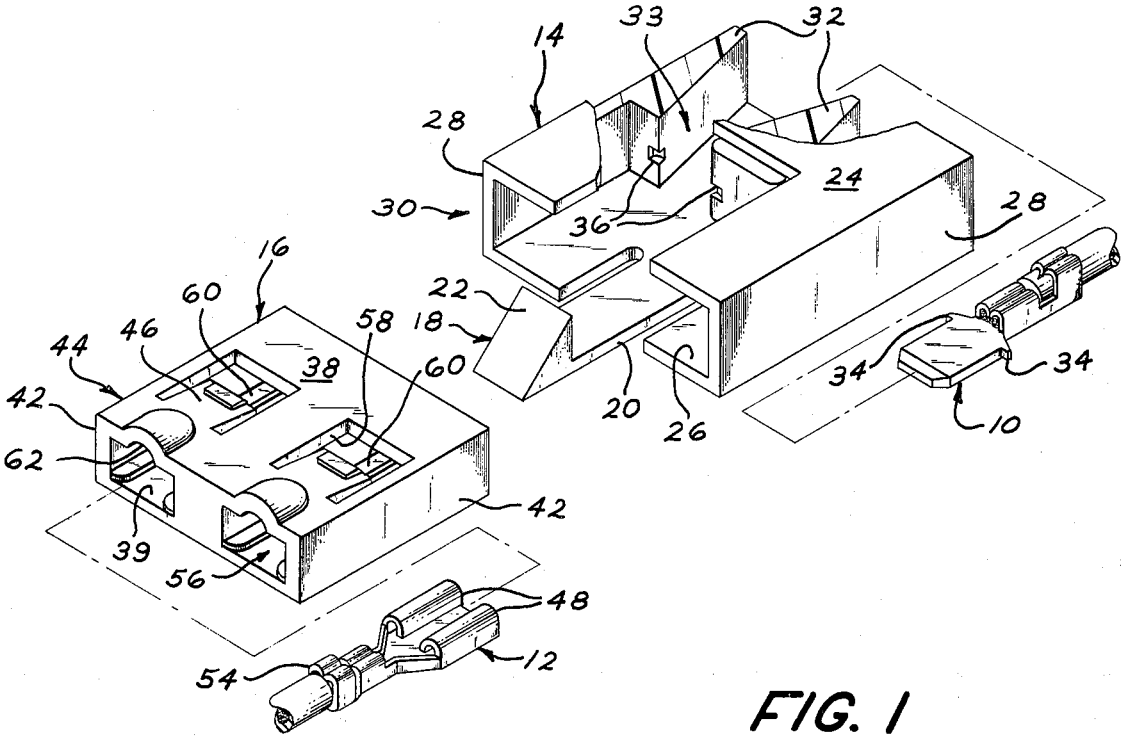
FIG. 1 is an exploded view, having portions cut away, showing the locking device of this invention.

FIG. 1 shows a spade 10 and a spade-receiving member 12 which can be joined to form a spade-type connector. In the present invention, there is presented a locking device for maintaining electrical connection in spade-type connectors which includes a case 14 and an insert 16 which is sized to telescope at least partially within case 14.

Attaching means 18 includes tongue 20 and projection 22 to interconnect case 14 and insert 16, thereby holding insert 16 into its telescoped position in case 14.

Case means 14 includes a top wall 24, a bottom wall 26, and opposed sidewalls 28, which form in combination a rectangular-shaped box 30.

Rectangular box 30 contains upstanding wedges 32 which lie in opposed relationship to each other, there being four such wedges in total, forming two constrictions 33 (only one of which is shown in the drawing), each of which is adapted to receive a spade 10. The constrictions are sized so that they are greater in width, when measured diagonally, than the width of a spade 10; yet, when measured transversely, they measure less than the width of the spade 10. Thus, a spade 10 may be inserted at an angle through the constriction 33 and then rotated slightly so that the ears 34 thereof engage notches 36 in the wedges to retain the spade in a fastening position.

In case 14, shown in FIG. 1, two such spades are held simultaneously in side-by-side relationship to engage two spade-receiving members when the locking device is assembled, as will be more fully described hereinafter.

Referring again to FIG. 1, insert 16 includes top wall 38, bottom wall 39, and opposed sidewalls 42, thereby defining a rectangular box 44 of slightly smaller outer dimensions than the inside dimensions of box 30 so that box 44 may be telescopically received therewithin. The insert 16 further includes inwardly projecting detents 46, integral with the top wall 38, which engage the edges of retainers 48 on spade-receiving member 12. The detents function to hold spade-receiving member 12 in position within insert 16 in spade-receiving relationship to the spades in case means 14.

Figure 2:
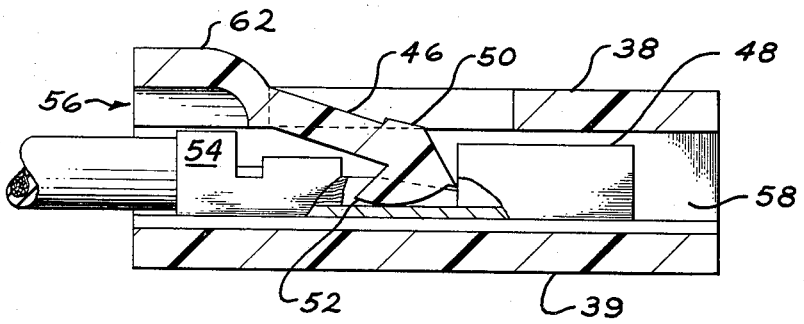
FIG. 2 is a cross-sectional view showing the spade-receiving member of a spade connection inserted into its respective body portion in the locking device of FIG. 1.

FIG. 2 shows detent 46 more clearly, wherein it can be seen that head 50 includes a hook 52 which is engageable with crimps 54 to prevent the spade-receiving member from being either withdrawn from or extended further, once inserted through first end opening 56 into insert 16. Thus, spade-receiving member 12 cannot be either forced forwardly completely through insert 16, nor can it be withdrawn once inserted therein but, rather, it is positively retained.

Insert 16 further includes a wall 58 extending parallel to and equidistant from opposed sidewalls 42 to divide box 44 into two compartments 60, each one of which includes a detent 46 projecting from top wall 38 downwardly thereinto. In addition, top wall 38 includes an upwardly convoluted portion 62 adjacent first end opening 56 to accommodate large wires which may be connected to spade-receiving member 12.

In the use of the locking device of this invention, both the case and the insert are placed on their respective members of the spade connector and then, themselves, connected together to simultaneously establish electrical contact between the respective connector members. More specifically, spade-receiving member 12 is inserted into insert 16 through first opening 56 until it is firmly held in position by detent 46 so that it can neither be withdrawn nor advanced further. Similarly, spade 10 is inserted through the constriction 33 formed by upstanding wedges 32 while on a diagonal. Then, spade 10 is rotated to a transverse position where its ears 34 engage notches 36 to position it for insertion into member 12. After both spade connector elements are in position in aligned relationship, or in the embodiment shown in FIG. 1, where two of each are in their proper positions, insert 16 is advanced and telescoped into case means 14. It will be noted that projection 22 includes a declivitous surface which is engaged by insert 16 to force projection 22 temporarily out of the way due to the flexibility of tongue 22. As insert 16 is being telescopically associated with case 14, the connection between spade 10 and receiving member 12 is simultaneously being established so that, when this connection is perfected, projection 22 is free to recover to its normal, unflexed position and engage insert 16 adjacent first opening 56. The electrical contact between the spade-type connectors has now been made and the connector elements are held firmly together by the locking device.

Having thus described the invention, what is claimed is:

1. A locking device for maintaining electrical connection in spade-type connectors comprising:

a case and an insert, telescoping at least partially thereinto, both being interconnectable by a single, centrally-located attaching means, said case comprising opposed sidewalls and a top and bottom wall, thereby defining a rectangular box, said box containing upstanding wedges in opposed relationship to form a constriction; the distance between the wedges, when measured diagonally is greater than the width of the spade member of a spade connection, and the distance, when measured transversely, is less than the width of said spade member to thereby engage the rear edges of a spade member inserted into said case through a first end opening to prevent the spade member's withdrawal from said case;

said case further having a flexible tongue integral with said bottom wall at a first end, said tongue having located at its free end a projection forming a part of said attaching means; and said insert comprising opposed sidewalls and top and bottom walls, thereby defining a rectangular box of slightly smaller dimensions than said box of said case, thereby permitting said insert to be partially telescoped into said case, said insert further comprising inwardly projecting detents integral with the top wall thereof to engage a spade-receiving member of a spade connection inserted into said insert through a first end opening to likewise prevent its withdrawal from said insert, said insert further comprising a wall extending parallel to and equidistant from said opposed sidewalls to divide said insert into two compartments, each having one of said detents projecting from said top wall downwardly thereinto, said top wall further including an upwardly convoluted portion adjacent a first end to accommodate the connection of a wire to said spade-receiving member;

said insert being insertable into said case to cause said wedges and detents, respectively, to hold said spade portions and said spade-receiving portions in electrical connection when said projection is hooked behind said first end of said insert.

2. The locking device of claim 1 wherein said detents further include projections attached to the underside thereof to engage said spade-receiving member and thereby prevent said spade-receiving member from being either withdrawn from or extended through the respective compartment of said insert.

3. The locking device of claim 2 wherein said wedges of said case cooperate to define a tapered entrance to guide a spade member inserted through said first end of said case into position.

* * * * *